United States Patent [19]

Arnold et al.

[11] 4,428,134

[45] Jan. 31, 1984

[54] CLOSURE TAB

[75] Inventors: Orlan M. Arnold, Norwalk, Conn.; Billy P. Noyes, 104 E. Rock Rd., Norwalk, Conn. 06851

[73] Assignee: Billy P. Noyes, Greenwich, Conn.

[21] Appl. No.: 435,658

[22] Filed: Oct. 21, 1982

Related U.S. Application Data

[63] Continuation of Ser. No. 139,912, Apr. 14, 1980, abandoned.

[51] Int. Cl.[3] ..... A44C 3/00

[52] U.S. Cl. ..... 40/2 R; 40/20 R; 24/30.5 S

[58] Field of Search ..... 24/30.5 S, DIG. 9, DIG. 28, 24/67.9; 40/2 R, 20 R

[56] References Cited

U.S. PATENT DOCUMENTS

| | | | |
|---|---|---|---|
| 2,756,525 | 7/1956 | Greenberger | 40/2 R |
| 2,905,586 | 10/1959 | Paxton et al. | 40/20 R |
| 2,975,091 | 3/1961 | Tobey | 40/2 R |
| 3,674,352 | 7/1972 | Wilmes | 101/DIG. 13 |
| 3,845,850 | 11/1974 | Herr et al. | 400/120 |
| 4,048,736 | 9/1977 | Castleman et al. | 40/2 R |
| 4,096,655 | 6/1978 | Ullman | 40/20 R |
| 4,110,502 | 8/1978 | Baer | 40/2 R |
| 4,159,586 | 7/1979 | Blum | 40/2 R |
| 4,268,179 | 5/1981 | Long et al. | 400/120 |

*Primary Examiner*—Gene Mancene
*Assistant Examiner*—Cary E. Stone
*Attorney, Agent, or Firm*—Bachman and LaPointe

[57] ABSTRACT

A tab which is readily imprinted with indicia comprises a substantially rigid substrate having a thermal or electrostatic sensitive print medium thereon. The tab is provided with attachment means for readily securing the tab to various merchandise.

13 Claims, 2 Drawing Figures

CLOSURE TAB

This is a continuation of application Ser. No. 139,912, filed Apr. 14, 1980, now abandoned.

BACKGROUND OF THE INVENTION

The present invention relates to an indicia bearing tab which is readily capable of being coded by means of thermal or electrostatic means. The tab is provided with attachment means for readily securing the tab to merchandise. The tab of the present invention is particularly useful in the thermal line printing system disclosed in co-pending U.S. application Ser. No. 139,954, filed Apr. 14, 1980, now U.S. Pat. No. 4,332,193 by Billy P. Noyes who is the assignee of the instant invention which co-pending application is incorporated herein by reference.

While the tab of the present invention will be described with reference to a closure tab for use in securing plastic bags or the like, it will be appreciated that broader applications can be made without departing from the principles described herein. The tab of the present invention is suitable for any type of production line operation or other operation which requires the coding of merchandise.

Known systems for directly coding merchandise or labels and tags or the like which are later applied to merchandise include printing with type blocks, stenciling, die stamping and the like. In the case of labels and tags or the like, the coded tag is then applied to the merchandise by tacking it thereto by means of glue, staples, wire, thread, etc. These known methods of coding and applying the coded item to the merchandise suffer from a number of costly disadvantages. The first and most important disadvantage is the fact that the coding information is unable to be readily changed without resulting in a loss of production time. A second and equally important disadvantage is that some of the coding systems are not suitable for relatively high speed production operations which require a throughput of 100 items per minute. A third and still equally important disadvantage is the inability to apply the coded item to the merchandise at the required production operation speed.

Accordingly, it is the principal object of the present invention to provide a tab which is readily attached to merchandise which is capable of being coded by means of thermal or electrostatic means.

It is a particular object of the present invention to provide a tab having a substantially rigid substrate provided with a thermal or electrostatic sensitive medium thereon.

It is a still further object of the present invention to provide the tab with attachment means for securing the tab to merchandise.

Further objects and advantages of the present invention will appear hereinbelow.

SUMMARY OF THE INVENTION

In accordance with the present invention the foregoing objects and advantages may be readily obtained.

The present invention provides an improved tab which is readily attached to merchandise which is capable of being coded by thermal or electrostatic means. The tab of the present invention is easily secured to the merchandise to be tagged at normal production rate speeds of about 100 items per minute.

In accordance with the present invention the tab comprises a substantially rigid substrate which is provided with a thermal sensitive or electrostatic sensitive medium thereon. The substrate is preferably composed of a plastic material. The thermal sensitive or electrostatic sensitive medium may take the form of print paper which is applied to the substrate by a pressure sensitive adhesive, a thermal sensitive adhesion or by a mechanical bond. It is also within the scope of the present invention to apply the thermal sensitive and electrostatic sensitive formulation directly on the rigid substrate.

Accordingly, it can be seen that the present invention provides an improved tab which is readily attached to merchandise and is capable of being coded by means of thermal or electrostatic means at production rate operating speeds.

DETAILED DESCRIPTION

Figure 1:
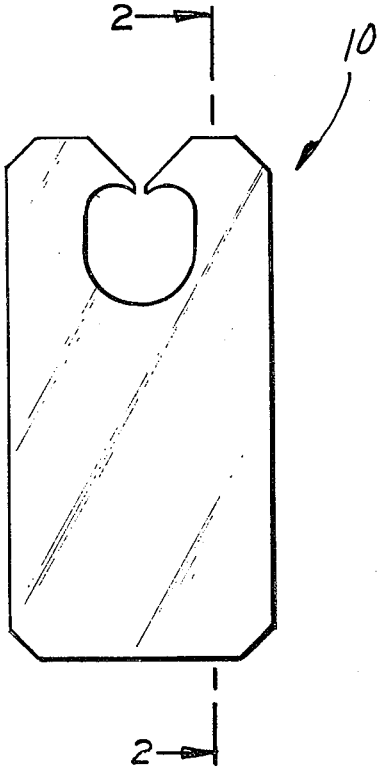
FIG. 1 is a front view of a closure tab in accordance with the present invention.
Figure 2:
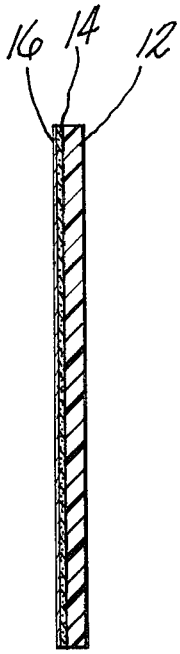
FIG. 2 is a sectional view of the closure tab of the present invention taken along line 2—2 of FIG. 1.

As noted previously, the tab of the present invention will be described in terms of a closure tab which is commonly used for securing the neck of a plastic bag or the like which contains merchandise. Again, it will be appreciated that broader applications can be made without departing from the principles to be described herein. Thus, the tab of the present invention is suitable for any type of production line operation or other operation which requires the coding of merchandise for any reason.

The improved tab 10 of the present invention comprises a substantially rigid substrate 12 which is provided thereon by means of an adhesive 14 with a thermal sensitive or electrostatic sensitive medium 16.

In accordance with the present invention, the substrate material 12 must be substantially rigid and have temperature and chemical stabilities which are capable of functioning in the particular thermal or electrostatic printing environment. Suitable materials include a wide variety of polymers and more particularly the preferred materials are polystyrene, polyvinyl chloride and polyamide or the equivalent. Likewise, plastic impregnated paper or fabric is suitable. The substrate material may be color coded with a series of colors as a code designation for the specific days the merchandise was produced and/or packaged or any other similar type of color coding.

The thermal sensitive or electrostatic sensitive medium 16 applied to the rigid substrate may take the form of a thermal or an electrostatic printing laminar paper component with a print composition (i.e., printing speed and print temperature) which is compatible with the operation speed of the particular production line the closure tab is to be used on. As with the substrate itself, the thermal printing or electrostatic printing laminar paper component may be color coded in the same manner as outlined above.

A number of different methods may be employed for bonding the print sensitive laminar to the rigid plastic substrate. One preferred method is to employ a pressure sensitive adhesive. In selecting a suitable pressure sensitive adhesive it is preferred that the adhesive become rigid at ambient temperatures. This is necessary in order to eliminate gumming of the stamping dies when the composite material is stamped into closure tabs after the application of the print sensitive laminar to the rigid plastic substrate. Suitable pressure sensitive adhesives include select mixtures of modified rubber base material mixed with resin. The adhesive must be as free as possible of water and solvents.

In lieu of employing a pressure sensitive adhesive, the print sensitive laminar may be applied to the rigid plastic substrate by means of a thermal sensitive adhesive in which case the adhesive must be compatible with the thermal or electrostatic printing temperatures so that the adhesive does not soften and flow at printing temperatures. Suitable thermal sensitive adhesives include select mixtures of vegetable and animal protein. As is the case with the pressure sensitive adhesives these adhesives must be substantially free of water and solvents.

In the case of both pressure sensitive and thermal sensitive adhesives 14 the adhesive is applied between the rigid substrate material 12 and the print sensitive laminar 16. In the case of thermal sensitive adhesives, the adhesive in a fluid state may be applied to either the substrate or the laminar and then cooled. The bond may then be made by bringing the substrate and laminar together and applying heat followed by cooling. In the case of pressure sensitive adhesives, the substrate and laminar are brought together and bonded by applying pressure.

In addition to the foregoing, a print sensitive formulation may be applied directly to the substrate material in a method similar to the method used in applying a print sensitive paper.

In accordance with the present invention, the rigid plastic substrate, after the print sensitive medium is applied thereto, is, in the case of closure tabs, die stamped and cut into closure tabs having a narrow edge opening which is inwardly enlarged for grabbing and closing the bag neck of a plastic bag. An example of the shape of the opening of a suitable closure tab are STRIPLOKS® manufactured by the Kwik Lok Corporation. For other applications, the tab may be stamped with any suitable means for attaching the tab to the merchandise to be tagged.

As noted above and thoroughly discussed in co-pending application Ser. No. 139,954, now U.S. Pat. No. 4,332,193, by employing the thermal sensitive closure tab of the present invention coding information may be applied to the closure tab at production speeds and coded information may be readily changed without the need of costly print blocks or production downtime.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A closure tab which is readily coded by printing means and used for securing and closing the bag neck of a flexible bag containing merchandise comprising:

a composite comprising a substantially rigid substrate, said substantially rigid substrate being characterized by sufficient rigidity so as to allow same to readily secure to and close the bag neck of a flexible bag, a thin layer of adhesive applied to one side of said substantially rigid substrate and bonded thereto, said thin layer of adhesive being adapted to receive a print sensitive medium, a print sensitive medium applied to said thin layer of adhesive on said one side of said substantially rigid substrate and bonded thereto so as to form said composite, said print sensitive medium being readily coded by said printing means while bonded to said substantially rigid substrate forming said composite wherein an edge portion of the composite is provided with means for receiving the bag neck of a flexible bag containing merchandise for securing and closing said flexible bag.

2. A closure tab according to claim 1 wherein said substantially rigid substrate is made of plastic.

3. A closure tab according to claim 2 wherein said plastic is selected from the group consisting of polystyrene, polyvinyl chloride and polyamide.

4. A closure tab according to claim 1 wherein said sensitive medium is a thermal printing laminar paper.

5. A closure tab according to claim 4 wherein said sensitive medium is applied to said substrate by means of a pressure sensitive adhesive.

6. A closure tab according to claim 4 wherein said sensitive medium is applied to said substrate by means of a thermal sensitive adhesive.

7. A closure tab according to claim 1 wherein said electrostatic sensitive medium is a printing laminar paper.

8. A closure tab according to claim 7 wherein said sensitive medium is applied to said substrate by means of a pressure sensitive adhesive.

9. A closure tab according to claim 7 wherein said sensitive medium is applied to said substrate by means of a thermal sensitive adhesive.

10. A closure tab according to claim 7 wherein said substrate is color coded.

11. A closure tab according to claim 1 wherein said substrate is color coded.

12. A closure tab according to claim 1 wherein said substantially rigid substrate is selected from the group consisting of plastic impregnated paper and impregnated fabric.

13. A closure tab according to claim 1 wherein said means for receiving comprises an opening on the edge portion of said composite having an inwardly enlarging aperture for receiving the bag neck of a flexible bag for closing said flexible bag.

* * * * *